US006227866B1

(12) United States Patent
Williams et al.

(10) Patent No.: US 6,227,866 B1
(45) Date of Patent: May 8, 2001

(54) TOWED ARRAY HANDLING SYSTEM ROTARY JOINT

(75) Inventors: Michael R. Williams; Stephan J. Diodato, both of West Kingston, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 09/364,918

(22) Filed: Jul. 26, 1999

(51) Int. Cl.[7] ..... H01R 39/00; H01R 4/64
(52) U.S. Cl. ..... 439/25; 439/201
(58) Field of Search ..... 439/13, 12, 11, 439/18, 25, 24, 23, 26, 201, 17; 310/219, 231, 232

(56) References Cited

U.S. PATENT DOCUMENTS 4,880,390 * 11/1989 Brackmann et al. ..... 439/204
4,909,741 * 3/1990 Schasteen et al. ..... 439/13
5,931,681 * 8/1999 Thomassin et al. ..... 439/25

* cited by examiner

*Primary Examiner*—Brian Sircus
*Assistant Examiner*—Chandrika Prasad
(74) *Attorney, Agent, or Firm*—Michael J. McGowan; Robert W. Gauthier; Prithvic C. Lall

(57) ABSTRACT

A rotary joint between a towed array and its towing vessel is provided having a drive plate, shaft and rotor attached to the towed array payout and take-in stowage drum and rotating with the drum. A thrust washer and bearing provide a rotating mechanical connection between these rotating components and the stationary housing and connector portions of the joint. The housing is fixed within the vessel and has an internal stator surrounding, and in electrical communication with the rotor. Electrical feeds from the towed array are connected to contact rings within the rotor, and the stator includes spring loaded pins in radial electrical contact with the rings as the rings rotate with the rotor. Electrical leads from the pins pass through the housing to the connector which is connected to the vessel's signal processing systems. In addition, the housing contains a pressure compensator within a passageway between the interior and exterior of the joint. The compensator has a piston sealed in the passageway and springs are provided to either side of the piston, such that the opposed expansion and contraction of the springs maintain a pressure differential over the piston.

9 Claims, 3 Drawing Sheets

TOWED ARRAY HANDLING SYSTEM ROTARY JOINT

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1). Field of the Invention

The present invention relates generally to a rotary joint providing mechanical and electrical connection, and more particularly to a rotary joint between a rotating handling system or winch and a stationary structure.

(2) Description of the Prior Art

Current rotary joints used in handling arrays of hydrophones towed behind a vessel are found to be failing prematurely, i.e., failures have been observed after significantly shorter time periods than design life. Replacing failed rotary joints is costly and, in the case of a submarine towed array, replacement is made more difficult as the joint is located in the ballast tank of the submarine. The current rotary joints are seen to have a number of design problems.

The rotary joints contain pressurized insulating fluid within their cavities, tending to allow easier rotation of the shaft about the journal bearing of the joint. When the array is towed from a submarine at depth, the ballast tank becomes pressurized, putting external pressure on the joint, tending to collapse the joint and also increasing friction between the shaft and bearing. Thus, a pressure compensator is provided in the rotary joint to maintain the positive pressure within the joint cavity relative to the ballast tank. Current rotary joint pressure compensators consist of a neoprene bladder which becomes brittle and cracks after repeated temperature and pressure variations. The cracking allows seawater to infiltrate the rotary joint causing reduction in insulation resistance between the conductors. The towed array performance is thus degraded until at some point the seawater intrusion results in a complete electrical short. Also, the electrical contacts of current rotary joints are made of a material subject to flaking during use, allowing conductive material into the insulating fluid. As with seawater, this flaking leads to performance degradation and eventually to an electrical short.

In the rotary joints used in submarines, the present design makes high use of proprietary components and long lead items for manufacture which raises unit costs and extends fabrication times. Consequently, the inventory is kept at a minimum with resultant replacement delays when failures throughout the fleet exceed inventories. As noted previously, the location of the rotary joint in the ballast tank of submarines presents replacement difficulties. The weight and size of present rotary joints increase the difficulty. Further, there are presently four separate designs for the rotary joints used in navy vessels, thus further complicating inventory maintenance and replacement. in and not allowing quick replacement of units.

SUMMARY OF THE INVENTION

Accordingly, it is an object of the present invention to provide a rotary joint having a pressure compensator made of corrosion resistant material more suitable to a marine environment.

Another object of the present invention is to provide a rotary joint having electrical contacts which minimize flaking of the contacts into the insulating fluid within the towed array.

A further object of the present invention is to provide a rotary joint having electrical contacts with an extended life cycle.

Still another object of the present invention is to provide a rotary joint having a journal bearing made of nonconductive, commercially available material such that wear on the bearing does not result in introducing conductive material into the insulating fluid.

A still further object of the present invention is to provide a rotary joint fabricated of commercial, or off-the-shelf parts to reduce costs and minimize replacement times.

Yet another object of the present invention is to provide a universal rotary joint design of reduced size and weight which can be used on all navy vessels.

Other objects and advantages of the present invention will become more obvious hereinafter in the specification and drawings.

In accordance with the present invention, a rotary joint is provided consisting of two main halves, a rotating half and a stationary half, fabricated of a titanium alloy to increase corrosion resistance in the marine environment and reduce the weight of the rotary joint by 50 percent compared to current designs. The rotating half has a universal mounting plate designed to be compatible with all current navy vessels. This plate attaches to the rotating stowage drum of the towed array handling system. The journal bearing of the new rotary joint is fabricated from a nonconductive material, so as to eliminate the possibility of introducing conductive particles into the insulating fluid within the towed array. An electrical connector mates with the towed array pendant cable and the inner rotating shaft has red brass contact rings to transmit the signals from the towed array to the stationary half of the rotary joint via stationary, spring loaded, red brass pins within the stationary half. The red brass rings and pins are less susceptible to flaking than current materials used. An electrical connector on the stationary half mates with the cable from the ship's internal systems. The stationary half of the rotary joint has an external housing mounted to a ship structure foundation. Again the mounting is universal to allow use of a single rotary joint design for all navy vessels. The pressure compensator has a dual spring design with a piston interposed between the two springs. The springs and piston are fabricated of corrosion resistant material, eliminating the neoprene bladder currently used along with its inherent problems. Readily available, commercial material has been used throughout the new rotary joint to lower costs and shorten fabrication lead times.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals refer to like parts and wherein.

DESCRIPTION OF THE PREFERRED EMBODIMENT

Figure 1:
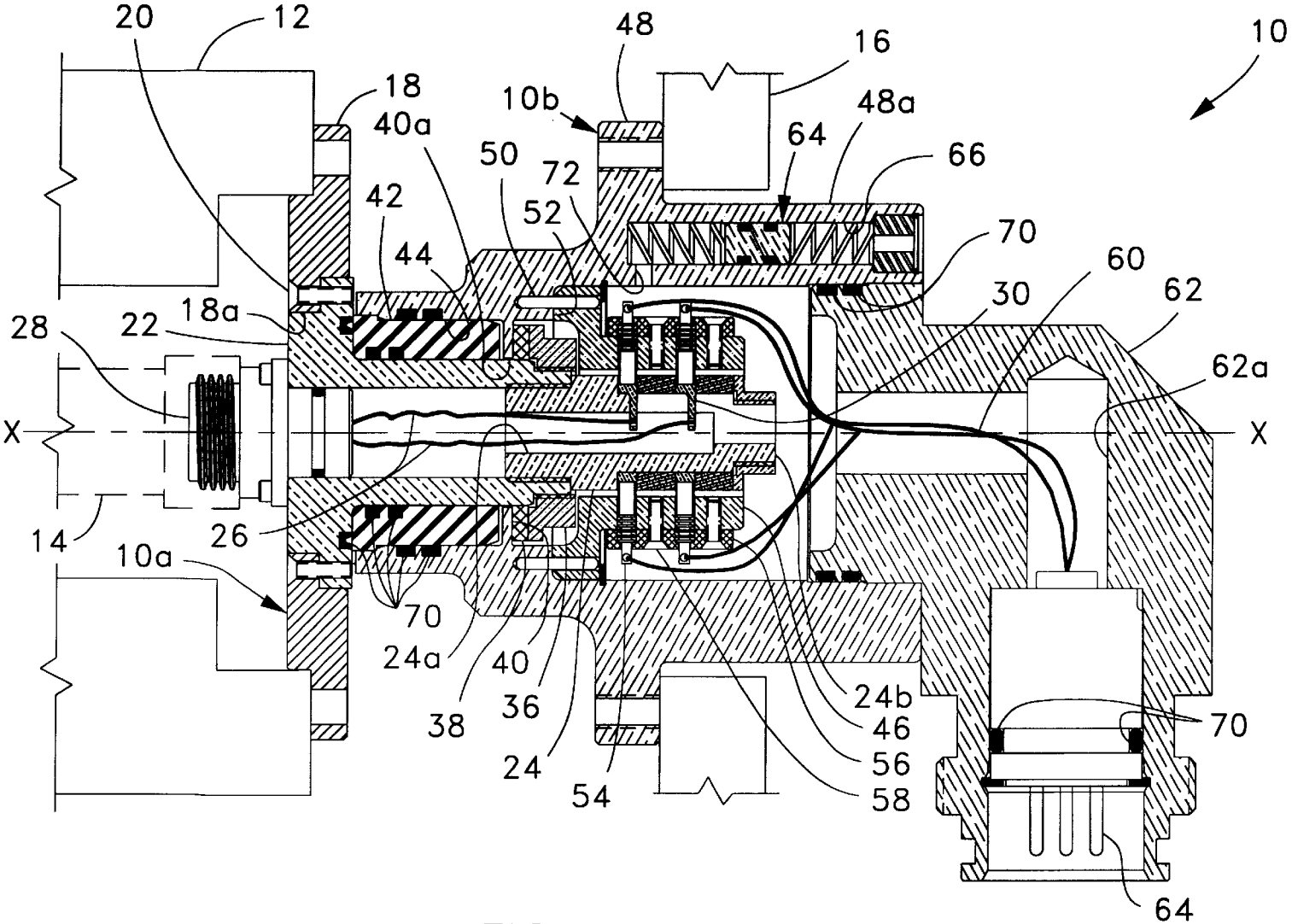
FIG. 1 is a cross sectional view of the rotary joint of the present invention.

Referring now to FIG. 1, there is shown a side cross sectional view of the rotary joint 10 of the present invention. The view is taken at a plane passing through the longitudinal axis X—X of rotary joint 10, rotary joint 10 being generally symmetrical about the plane. Rotary joint 10 is used to provide mechanical and electrical connection between the rotating stowage drum 12 for towed array 14 (shown in phantom in FIG. 1), as would be found on any number of seagoing vessels (not shown), and a stationary foundation structure 16 of the vessel. It will be appreciated that rotary joint 10 is not limited to use for a towed array, but can be used to provide mechanical and electrical connections between many forms of rotating and stationary elements. Rotating portion 10*a* of rotary joint 10 includes a drive plate 18, generally annular, which is fixed to stowage drum 12 and rotates with drum 12. Drive plate 18 can be easily configured to adapt to the mounting configuration of drum 12 such that rotary joint 10 can be used for any number of drum configurations. Drive plate 18 is removably attached, such as by bolts 20, to hollow shaft 22 of rotating portion 10*a*, which protrudes through annular opening 18*a* of drive plate 18. Being so removably attached, only drive plate 18 need be changed when rotary joint 10 is used with a different drum 12 mounting configuration. Generally cylindrical rotor 24 is attached to shaft 22, such as by threading into shaft 22. Bore 24*a* of rotor 24 extends partway along axis X—X and is open to hollow shaft 22 to provide a passageway for electrical leads 26 into rotor 24. Electrical leads 26 provide for signal transmission from towed array 14 via towed array connector 28, which is fixed to shaft 22 adjacent drive plate 18. Electrical leads 26 provide electrical connection between towed array 14 and contact rings 30, mounted in rotor 24. Two contact rings 30 are shown, one for each electrical lead 26. Additional contact rings can be provided as the number of leads increases.

Figure 2A:
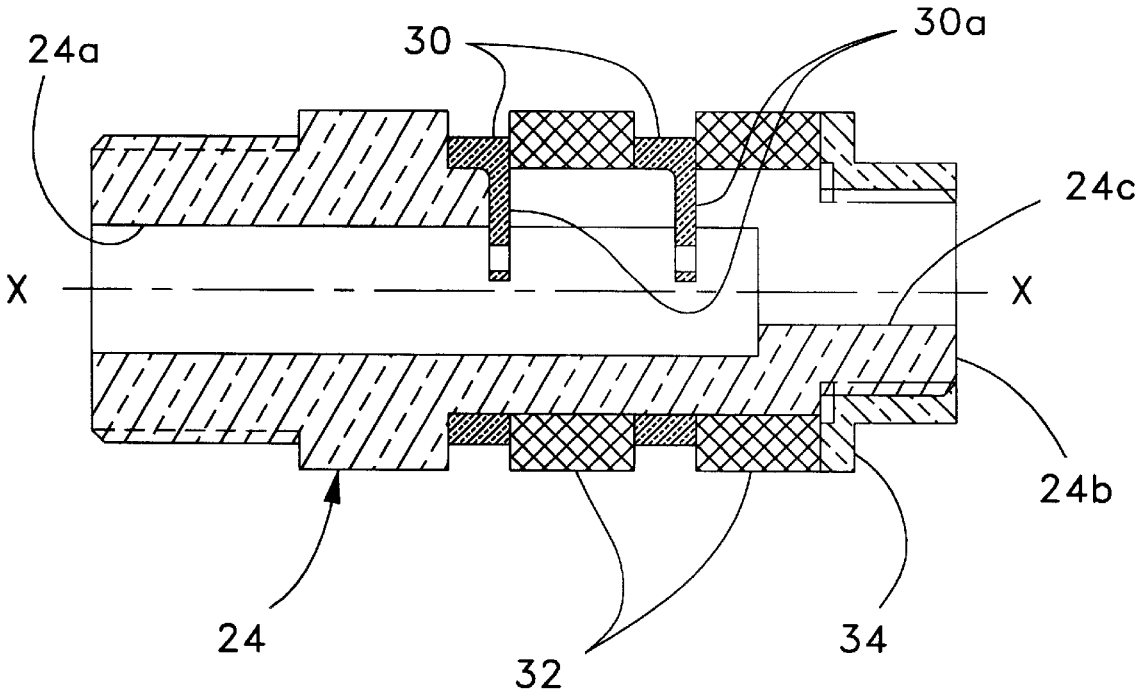
FIG. 2A and 2B are a detailed cross sectional view and end view, respectively, of a rotor component of the present invention.
Figure 2B:
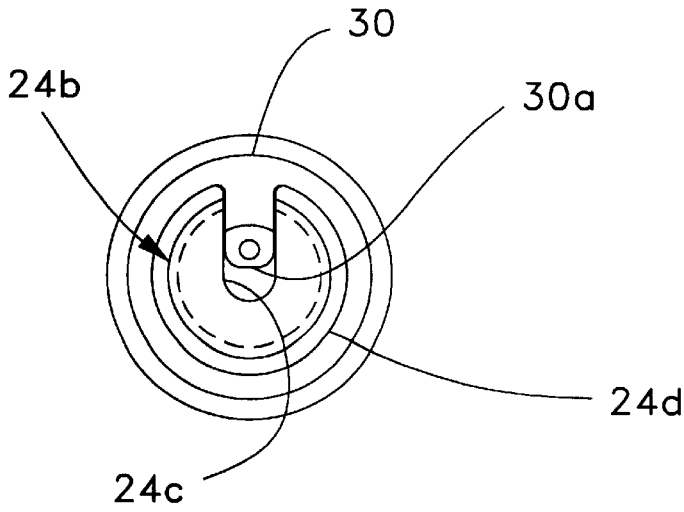

Referring now also to FIGS. 2A and 2B, there is shown a larger scale cross sectional view and an end 24*b* view, respectively, of rotor 24 and contact rings 30. Rotor 24 includes a slot 24*c* extending radially from the outside surface 24*d* of rotor 24 to approximately axis X—X, and extending longitudinally from end 24*b*, opposite bore 24*a*, partway into bore 24*a*. Contact rings 30 are sized to fit about rotor 24 and have a finger portion 30*a* extending radially inward, approximately to axis X—X. Finger portion 30*a* is sized to fit within slot 24*c*, such that rings 30 are prevented from rotating about rotor 24. Spacers 32 (shown in FIG. 2A) are provided between rings 30 and between rings 30 and retainer 34 (shown in FIG. 2A) so as to hold rings 30 in the correct longitudinal position. Retainer 34 is removably attached to rotor 24 such as by threading onto rotor 24. Shaft retainer 36 threads onto shaft 22 and seats against thrust washer 38. Thrust washer 38 seats against internal annular flange 40 of stationary portion 10*b* of rotary joint 10, shaft 22 extending through annular opening 40*a* of flange 40. Thus shaft retainer 36 and thrust washer 38 serve to hold rotating portion 10*a* and stationary portion 10*b* of rotary joint together. Journal bearing 42 surrounds shaft 22 within cylindrical bearing opening 44 of stationary portion 10*b* in a position on the opposite side of flange 40 from thrust washer 38, allowing rotating portion 10*a* to rotate relative to stationary portion 10*b*. Generally cylindrical stator 46 surrounds rotor 24 adjacent rings 30 and spacers 32, and is affixed internally within hollow cylindrical stator housing 48 of stationary portion 10*b*. In the embodiment shown, press fit pins 50 attach stator 46 to internal shoulder 52 of housing 48. Although any well known means may be used for attachment, press fit pins 50 serve also to properly align stator 46 within housing 48.

Figure 3:
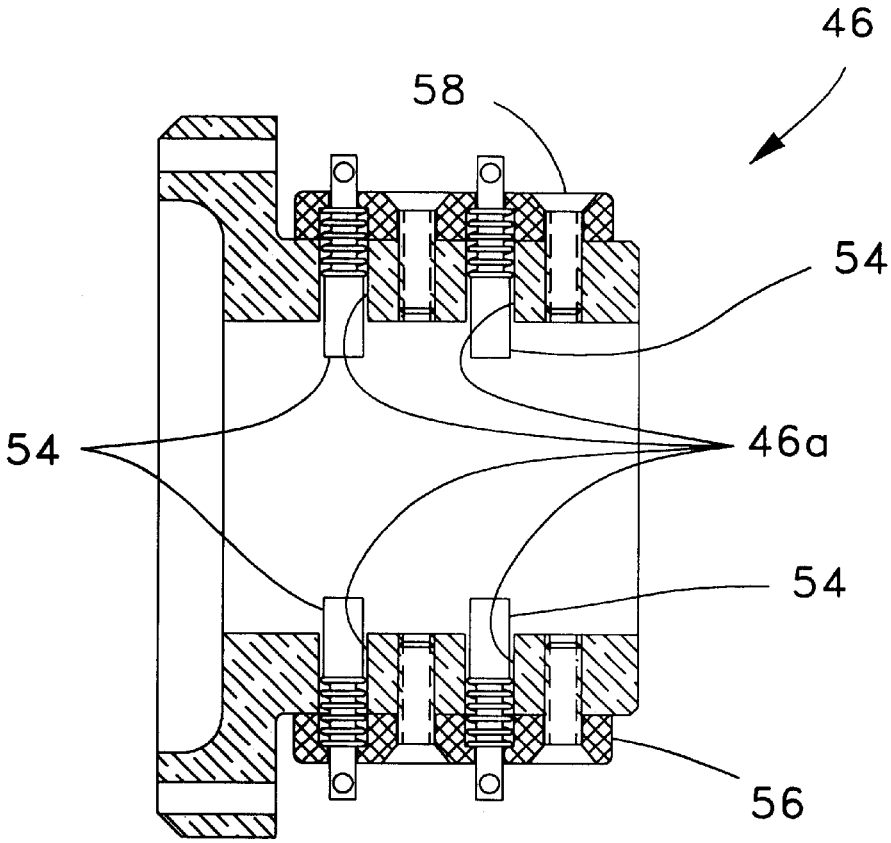
FIG. 3 is a detailed cross sectional view of a stator component of the present invention.

Referring now also to FIG. 3, there is shown a detailed cross sectional view of stator 46. Stator 46 has two diametrical bores 46*a* completely therethrough. Spring loaded contact pins 54 extend from each side through bores 46*a* and make electrical contact with contact rings 30 of rotor 24 within stator 46. Thus, for each electrical lead 26, two contact points are provided, one at each pin 54. Pin retainer 56 surrounds stator 46 to hold pins 54 in place. Pin retainer 56 may be attached to stator 46 in any well known manner, such as by cap screws 58 shown in the embodiment of FIG. 1. Stator electrical leads 60 are connected to contact pins 54 at the ends of pins 54 remote from contact rings 30. Leads 60 pass through housing 48, through connector housing 62 of stationary portion 10*b* by means of bore 62*a*, and are connected to connector plug 64. Plug 64 in turn would mate with the vessel's internal array processing equipment (not shown). In the embodiment shown, stator housing 48 is firmly affixed to foundation 16, such as by bolting. This allows connector housing 62 to be easily inserted into stator housing 48 and provides easier access to stator 46, rotor 24 and their various components. However, either stator housing 48 or connector housing 62 may be connected to foundation 16, depending on the vessel configuration.

Figure 4:
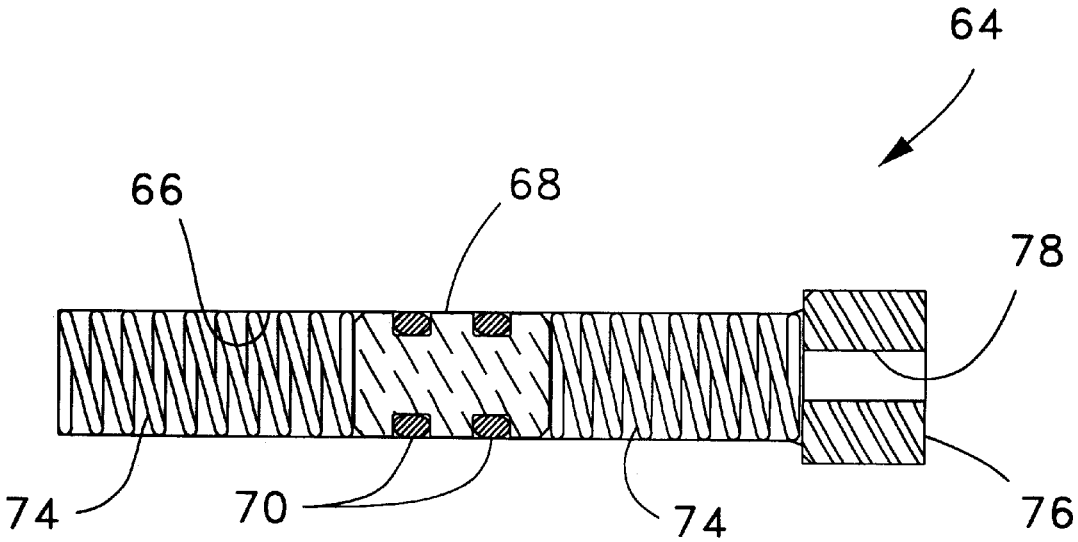
FIG. 4 is a detailed cross sectional view of a pressure compensator component of the present invention.

Referring now also to FIG. 4, there is shown a detailed cross sectional view of pressure compensator 64. In the embodiment shown, pressure compensator 64 is located in pressure bore 66 extending longitudinally within the cylindrical shell portion 48*a* of stator housing 48. (Only the interior outline of bore 66 is shown in FIG. 4.) Piston 68 of pressure compensator 64 is sealed within pressure bore 66 as by o-rings 70 to prevent fluid passage around piston 68. Radial bore 72 extends radially inward from pressure bore 66 through shell portion 48*a*, so as to provide fluid communication with the interior of stator housing 48. Rotary joint 10 may be utilized in the ballast tank of a submarine (nor shown). In such applications, the interior of rotary joint 10, e.g., hollow shaft 22, rotor bore 24*a* and housing 48, are filled with an insulating fluid having a positive pressure differential compared to the ballast tank. This fluid aids in lessening friction between shaft 22 and bearing 42. The fluid is in fluid communication with piston 68 via radial bore 72. Additional o-rings and seals 70 are provided between other surfaces of rotary joint 10 to prevent any fluid communication between the exterior and interior of rotary joint 10. To maintain the positive pressure differential, springs 74 are provided on each side of piston 68. Springs 74 oppositely contract and expand in response to the changing pressure within the ballast tank to maintain the positive pressure differential between the interior and exterior of stator housing 48. Cap 76 retains the springs 74 and piston 68 within longitudinal bore 66 and has a cap bore 78 therethrough to maintain fluid communication between piston 68 and the exterior of stator housing 48. In addition to lessening friction between shaft 22 and bearing 42, the positive pressure differential maintained by pressure compensator 64 prevents collapse of rotary joint 10 should pressure within the ballast tank greatly exceed the insulating fluid pressure within rotary joint 10.

The invention thus described is a mechanical and electrical rotary joint between a towed array and its towing vessel. A drive plate, shaft and rotor are attached to the towed array stowage drum and rotate with the drum as the towed array is payed out or taken in. A thrust washer and bearing provide a rotating mechanical connection between these rotating components and the stationary components of the joint consisting essentially of a housing and a connector portion. The housing is fixed to a suitable foundation within the vessel and has an internal stator surrounding and in electrical communication with the rotor. Electrical feeds from the towed array are connected to contact rings within the rotor, and the stator includes spring loaded pins in radial electrical contact with the rings as the rings rotate with the rotor. Electrical leads from the pins pass through the housing to the connector component of the joint such that electrical signals from the towed array are passed to the vessel's signal processing systems. In addition, the housing contains a pressure compensator to maintain a positive pressure differential between the interior and exterior of the joint. The compensator consists of a piston sealed within a passageway between the interior and exterior of the joint. Springs are provided to either side of the piston and the opposed expansion and contraction of the springs maintains the pressure differential the piston.

The housing, connector portion, drive plate and shaft are fabricated of lightweight, high strength, corrosion resistant material to reduce size and weight. In the preferred embodiment, these components are fabricated from a titanium alloy such as Ti-6Al-4V. The compensator piston, as well as the cap used to retain the piston and springs within the joint, are also fabricated of this titanium alloy. The dual spring design and the corrosion resistant material provide a highly reliable pressure compensator. In addition, the contact rings and pins are fabricated of red brass to maximize corrosion resistance and minimize wear. The dual contact pins for each contact ring provide a measure of redundancy should one of the pins wear out, or otherwise fail. Further, the bearing and thrust washer are fabricated of synthetic, non-conductive material and are designed to be commercially available. Being of non-conductive material, any wear on the bearing or washer will not cause electrical shorts between the contact rings or the pins.

Although the present invention has been described relative to a specific embodiment thereof, it is not so limited. Thus, it will be understood that many additional changes in the details, materials and arrangement of parts, which have been herein described and illustrated in order to explain the nature of the invention, may be made by those skilled in the art within the principle and scope of the invention as expressed in the appended claims.

What is claimed is:

1. A rotary joint providing mechanical and electrical connection between a rotating element and a stationary element, the joint comprising:

a rotating portion fixed and rotating with the rotating element;

a stationary portion fixed to the stationary element;

a shaft assembly mechanically connecting the rotating portion and the stationary portion;

a non-conductive, cylindrical rotor base coaxial with and affixed to the shaft assembly, electrically connected to the rotating element and rotating with the rotating element, the rotor base having a longitudinal central bore extending from a first end of the rotor base and partway therethrough;

at least two electrically conductive contact rings, each contact ring separately positioned circumferentially about the rotor base and having a ring projection extending radially into the central bore;

an electrical rotating lead for each contact ring extending from the rotating element, through the central bore and to the ring projection of the contact ring; and a stator attached to the stationary portion and electrically connected to the stationary element, the stator further making separate electrical contact with each contact ring.

2. The rotary joint of claim 1 wherein the shaft assembly further comprises:

a hollow cylindrical shaft coaxial with the rotating element, the shaft extending into an open cylindrical section of the stationary portion, the rotor base being fixed to the shaft within the stationary portion;

a shaft retainer securing the shaft against an interior annular flange within the open cylindrical section of the stationary portion;

a thrust washer interposed between the shaft retainer and the interior annular flange; and a bearing surrounding the shaft and interposed between the shaft and the cylindrical section, the thrust washer and bearing allowing rotational movement of the rotating portion with respect to the stationary portion while maintaining axial positioning of the shaft assembly within the stationary portion.

3. The rotary joint of claim 1 wherein the stator further comprises:

hollow cylindrical stator base surrounding and spaced apart from the rotor base;

an electrically conductive contact pin for each contact ring, the contact pin extending radially through the stator base and making electrical contact with the contact ring;

an electrical stationary lead for each contact pin connected between the contact pin and the stationary element; and a pin retainer for each contact pin biasing the contact pin in a radially inward direction to maintain electrical contact between the contact pin and the contact ring.

4. The rotary joint of claim 1 further comprising a pressure compensator in fluid communication with an insulating fluid within the rotating element and in separate fluid communication with a surrounding fluid exterior of the stationary element, the pressure compensator adjusting to pressure differentials between the insulating fluid and the surrounding fluid so as to maintain a pressure differential over the pressure compensator.

5. The rotary joint of claim 4 wherein the pressure compensator further comprises:

a piston sealingly interposed between the insulating fluid and the surrounding fluid;

a first spring biasing the piston in a direction opposed to a pressure from the insulating fluid; and a second spring biasing the piston in a direction opposed to a pressure from the surrounding fluid and opposed to the biasing direction of the first spring.

6. The rotary joint of claim 5 wherein the pressure compensator is movably sealed within a bore in the stationary portion, the bore extending between the surrounding fluid and the insulating fluid, the first spring being within the bore adjacent a side of the piston removed from the insulating fluid, insulating fluid pressure on the piston causing the first spring to compress, the second spring being within the bore adjacent an opposite side of the piston removed from the surrounding fluid, surrounding fluid pressure on the piston causing the second spring to compress.

7. The rotary joint of claim 1, further comprising:

a slot extending longitudinally and partway along the rotor base from a second end of the rotor base opposite the first end so as to overlap the central bore, the slot extending radially inward from an outer surface of the rotor base so as to intersect the central bore in the overlap of the slot and central bore, the ring projection of each contact ring extending through the slot into the central bore to maintain radial alignment of the contact ring and the rotor base; and non-conductive spacer rings positioned circumferentially about the rotor base, at least one spacer ring being positioned between each pair of contact rings.

8. A contact ring assembly comprising:

a non-conductive, cylindrical rotor base having a longitudinal central bore extending from a first end of the rotor base and partway therethrough;

at least one electrically conductive contact ring positioned circumferentially about the rotor base and having a ring projection extending radially into the central bore;

a slot extending longitudinally and partway along the rotor base from a second end of the rotor base opposite the first end so as to overlap the central bore, the slot extending radially inward from an outer surface of the rotor base so as to intersect the central bore in the overlap of the slot and central bore, the ring projection of the at least one contact ring extending through the slot into the central bore to maintain radial alignment of the at least one contact ring and the rotor base; and at least one non-conductive spacer ring positioned circumferentially about the rotor base and adjacent the at least one contact ring to electrically isolate the at least one contact ring.

9. The contact ring assembly of claim 8, further comprising a retainer ring removably affixed to the base to secure the at least one contact ring and the at least one spacer ring on the rotor base in an axial direction.

* * * * *